US005534762A

United States Patent [19]

Kim

[11] Patent Number: 5,534,762

[45] Date of Patent: Jul. 9, 1996

[54] SELF-PROPELLED CLEANING ROBOT OPERABLE IN A CORDLESS MODE AND A CORD MODE

[75] Inventor: Ji-Hyun Kim, Suwon, Rep. of Korea

[73] Assignee: Samsung Electronics Co., Ltd., Suwon, Rep. of Korea

[21] Appl. No.: 313,567

[22] Filed: Sep. 27, 1994

[30] Foreign Application Priority Data

Sep. 27, 1993 [KR] Rep. of Korea ..... 93-19893

[51] Int. Cl.[6] ..... B25J 5/00

[52] U.S. Cl. ..... 318/568.12; 318/568.11; 15/340.1; 134/188; 307/66

[58] Field of Search ..... 318/568.12, 568.11; 15/340.1, 320; 134/188; 307/66, 64

[56] References Cited

U.S. PATENT DOCUMENTS 4,210,978 7/1980 Johnson et al. ..... 15/320
4,536,694 8/1985 McCarty et al. ..... 15/340.1
5,001,635 3/1991 Yasutomi et al. ..... 15/340.1
5,402,051 3/1995 Fujiwara et al. ..... 318/568.12

FOREIGN PATENT DOCUMENTS 62-152422 7/1987 Japan .
3-184105 8/1991 Japan .

*Primary Examiner*—William M. Shoop, Jr.
*Assistant Examiner*—Karen Masih
*Attorney, Agent, or Firm*—Burns, Doane, Swecker & Mathis

[57] ABSTRACT

A cleaning robot is operable in either a cord mode (by means of a plugged-in cord) or a cordless mode (by means of a battery). The robot includes a self-propulsion mechanism for advancing the robot during a cleaning operation, and a cord that can be plugged into an external power supply for powering the cleaning device and self-propulsion mechanism and a vacuuming mechanism during the cleaning operation. Following the cleaning operation, the vacuuming mechanism is deactivated, and the self-propulsion mechanism is powered by a battery carried by the robot for advancing the robot to the next area to be cleaned.

9 Claims, 5 Drawing Sheets

SELF-PROPELLED CLEANING ROBOT OPERABLE IN A CORDLESS MODE AND A CORD MODE

FIELD OF THE INVENTION

The present invention generally relates to a self-propelled robot cleaner capable of cleaning a floor while moving along the floor.

BACKGROUND OF THE INVENTION

In general, robot cleaners can be classified into a cord type and a cordless type.

There has been proposed the wire type cleaner which has a cable assembly disclosed in Japanese Patent Laid-open Publication No. Sho 62-152422.

The core type cleaner disclosed in this Japanese Patent, however, a moving range of the cleaner is restricted by the length of a power cord for connecting the cleaner with a power source terminal.

Also, when the cleaner cleans several rooms, a plug of the power cord must be frequently plugged in the power source terminal at different positions because the power cord is short.

As another conventional cleaner, there is, of course, the well known cordless type cleaner disclosed in Japanese Patent laid-open pyung 3-184105.

Although the cordless type cleaner disclosed in this Japanese Patent laid-open publication, a moving range not restricted by the length of the power cord, nevertherless, not only can the cleaning not be performed for a long time but also a battery may have to be charged at any time because a battery capacity is restricted.

In order to overcome the problems described above, if the battery were manufactured to be of increased capacity, not only a battery weight as well as cost of the cleaner is increased, but also it is very inconvenient to use the battery. Further, the cordless type cleaner operates without the power cable only in the case of an automatic mode.

SUMMARY OF THE INVENTION

It is, accordingly, an object of the present invention to overcome the disadvantages in the prior art, to provide a robot cleaner which is capable of cleaning by using of alternating current applied from a separate station during a cleaning operation, so that the cleaning operation is finished in a short time.

Another object of the present invention is to provide a robot cleaner which is capable of moving to the next area to be cleaned by using only battery voltage, to thereby decrease the battery capacity and cost.

It is a further object to provide a robot cleaner which is capable of cleaning by alternating current while moving on a cleaning range, and moving by battery voltage while moving from one cleaning area to another to avoid the need to provide an additional extension cord for connecting the plug with a main power-source.

The foregoing objects are accomplished in one embodiment by providing a robot cleaner comprising: control means; driving means for driving left and right power wheels to cause the robot cleaner to be moved in forward, backward, left and right directions under the control of the control means; power supply means for supplying AC to an apparatus in order to perform the cleaning under the control of the control means; travel distance detecting means for detecting a traveled distance by the driving means; travel direction detecting means for detecting a travel direction changed by the driving means; obstacle sensing means for sensing a presence of an obstacle and a distance to said obstacle; battery means for supplying DC to a body in order to change a cleaning range under the control of the control means; charging means for charging the battery of the robot cleaner when a charging voltage of the battery is decreased to below a predetermined level.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

A robot cleaner according to an embodiment of the present invention will now be described by referring to accompanying drawings.

Figure 1:
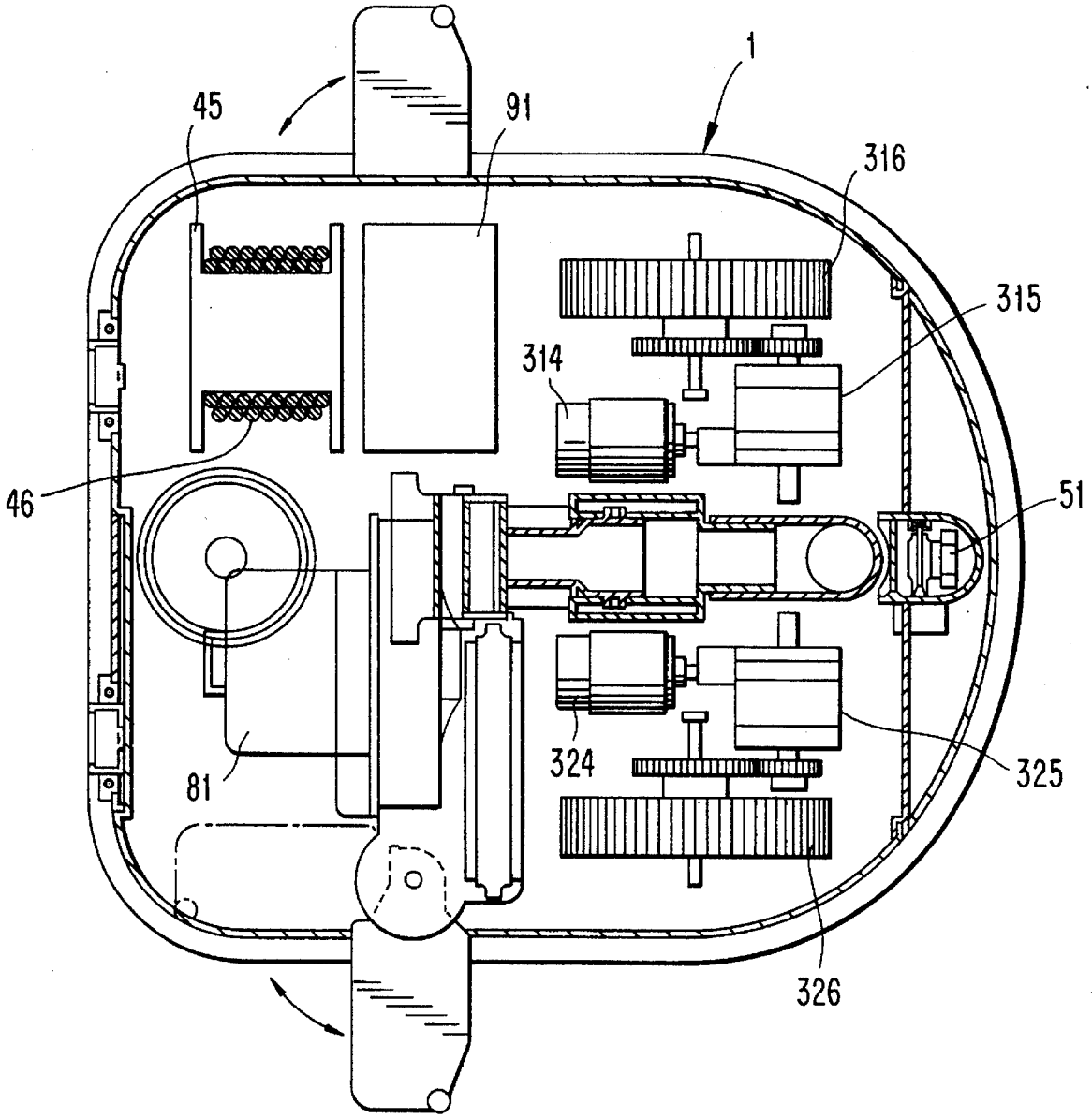
FIG. 1 is a plan view of a robot cleaner of the present invention from which a top cover has been removed.
Figure 2:
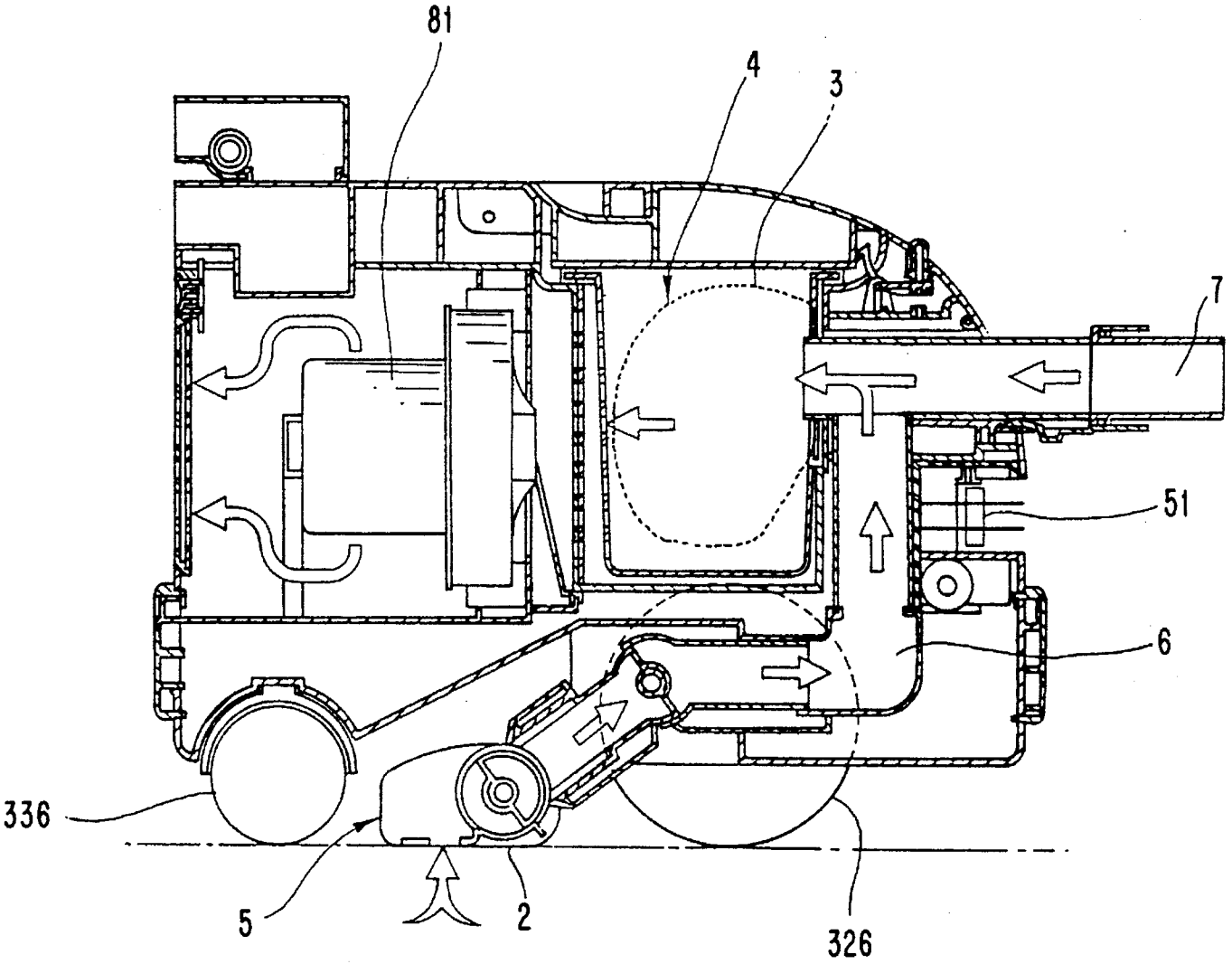
FIG. 2 is a vertical sectional view of the robot cleaner according to the present invention.
Figure 4:
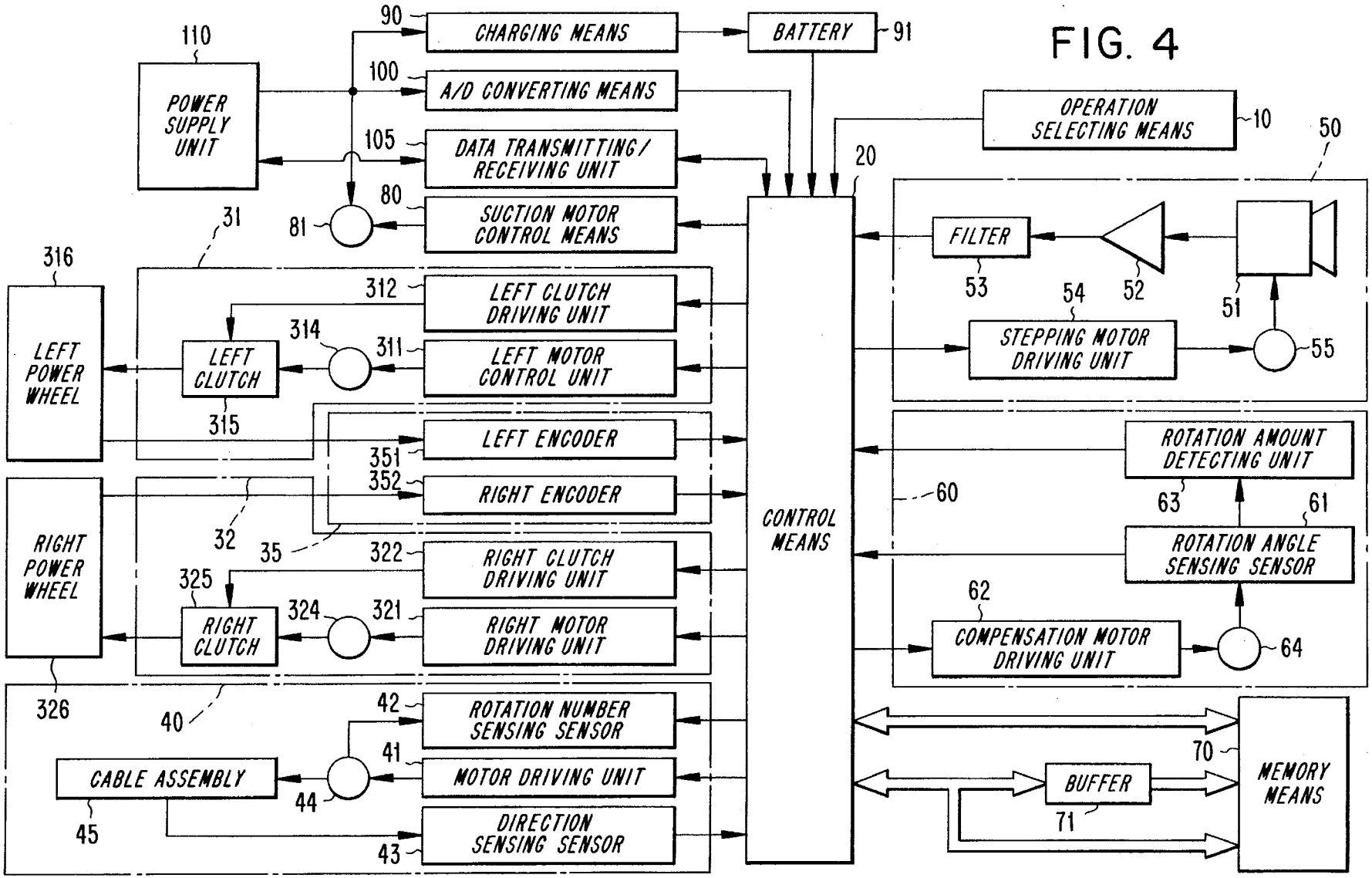
FIG. 4 is a block diagram of an operating system the robot cleaner according to the present invention.

In FIGS. 1 and 2, reference numeral 1 denotes a robot cleaner, which comprises an ultrasonic sensor 51, which emits an ultrasonic wave in a moving direction while being turned about 180 degrees from the forward direction by a rotation force from a driving unit such as motor 53 (see FIG. 4). The sensor 51 receives the reflected wave in order to determine a presence of and a distance to an obstacle.

Left and right motors 314 and 324 are attached below the ultrasonic sensor 51 in order to turn the robot cleaner 1 to the left, right, forward and backward directions, and left and right clutches 315 and 325 are provided in order to transmit the driving force from motors 314, 324 to left and right power wheels 316 and 326. The motors 314, 324, the clutches 315, 325 and the steerable ground support structure defined by the wheels 316, 326, together constitute a motor-driven propulsion mechanism.

The left and right clutches 315 and 325 operate to connect or separate the left and right motors 314 and 324 with respect to the left and right power wheels 316 and 326 when the robot cleaner 1 operates in a automatic mode, or in a manual mode, respectively.

Furthermore, wound on a spool assembly 45 is a power cord or cable 46 which is capable of being withdrawn or retracted during a cleaning operation is mounted at the rear of the robot cleaner 1, and a battery 91 is mounted at the front of the cable assembly 45 in order to supply DC current to the robot cleaner 1 while the robot travels to another area to be cleaned.

A suction motor 81 is mounted in the robot cleaner 1 in order to generate a suction to suck up dust or other foreign material, and a collecting chamber 4 is constructed side by side with the suction motor 81, which has a dust collecting bag 3 as shown in FIG. 2.

A free wheeling wheel 336 is rotatably mounted on the lower side of the robot cleaner 1.

As shown in FIG. 2 in detail, a brush 5 is disposed between the wheel 336 and the left and right power wheels 316 and 326 in order to conduct the dust and foreign materials which are sucked-up from the floor during an automatic mode of operation.

The dust collecting bag 3 collects a dust through the suction inlet 2 and a conduit 6 during the automatic mode.

Meanwhile, the robot cleaner 1 has a suction conduit 7 for sucking the dust from the floor when the robot cleaner 1 is converted from the automatic mode to the manual mode, as shown in FIG. 2.

That is, the suction conduit 7 is attached to the robot cleaner 1 for performing the cleaning in the manual mode, a cover should be (not shown) removed from a front end of the robot cleaner 1 in the case of the manual mode to permit the attachment of the suction conduit 7.

Meanwhile, the suction conduit 7 should be removed from the robot cleaner 1 and replace by thee cover (not shown) when the robot cleaner 1 operates in the automatic mode.

Operation of the selecting means of the invention will now be described with reference to FIG. 3.

The operation selecting means comprises an operation/stop key 11 for connecting or interconnecting a power source to the robot cleaner 1.

A display unit 11*a* is turned on when the operation/stop key 11 is once pushed by the user, the display unit 11*a* is turned off when the operation/stop key 11 is pushed once more again.

An automatic selecting key 12 is provided to determine the operating mode of the robot cleaner 1, i.e., the automatic mode or manual mode.

That is, when the key 12 is once pushed by the user, the display unit 12*a* is turned on so that the user can perceive that the robot cleaner 1 is operated in the automatic mode. When the key is pushed once more again by the user, the display unit 12*a* is turned off so that the user can perceive that the robot cleaner is operated in the manual mode.

A light emitting diode, in general, is used for the keys 11 and 12.

Meanwhile, it can be constructed so that the robot cleaner 1 may be controlled by a remote controller (not shown) when the robot cleaner 1 operates in the automatic mode.

Figure 3:
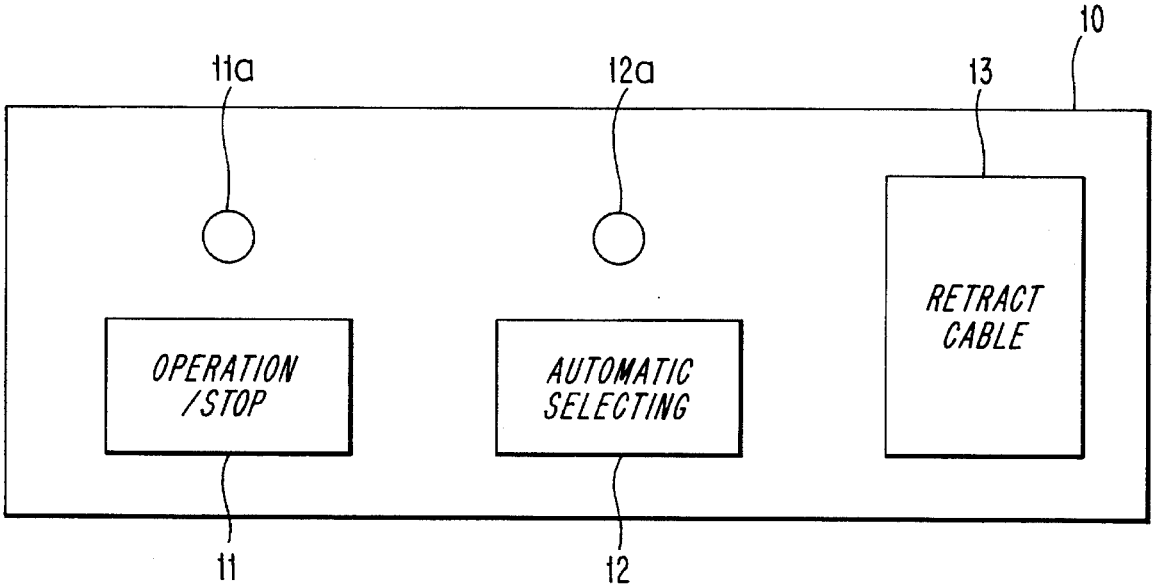
FIG. 3 is a schematic view of a control panel of the robot cleaner according to the present invention.

Furthermore, in FIG. 3, entering key 13 performs the same function as in a conventional cleaner and is used for winding-up the cable 46.

Figure 5:
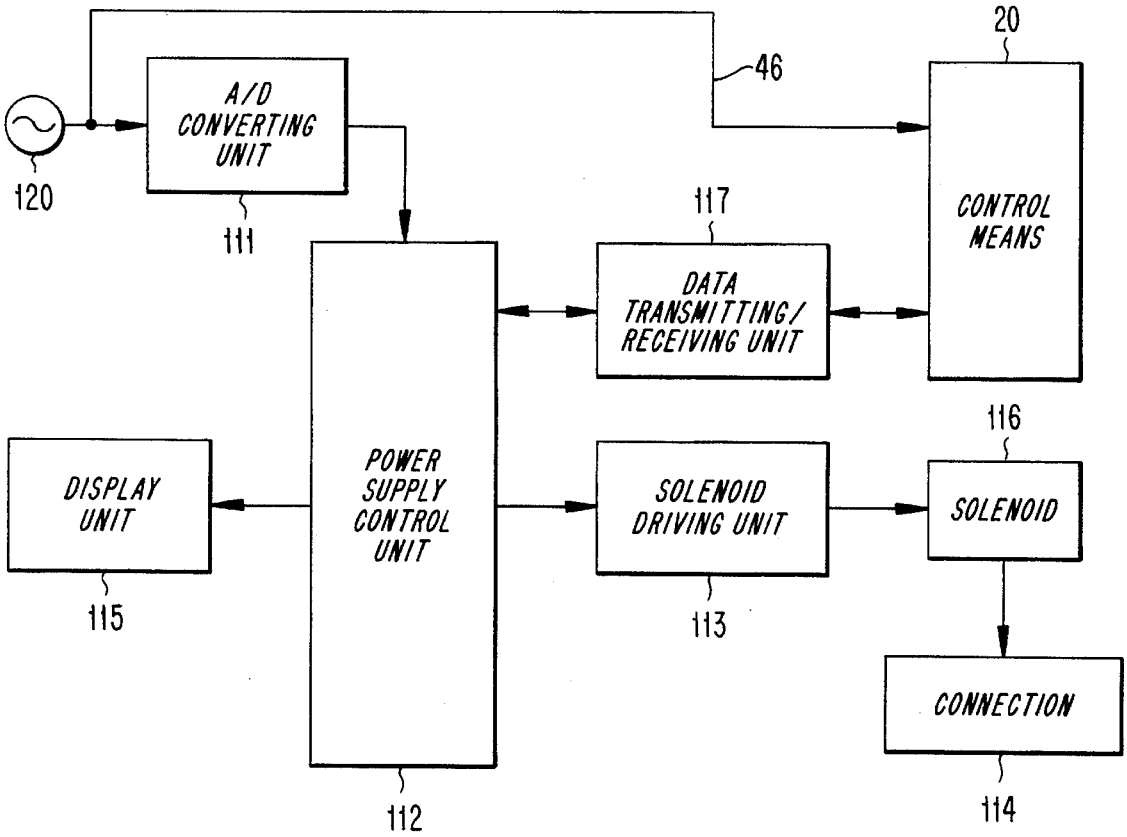
FIG. 5 is a block diagram for a power supply unit of the robot cleaner according to the present invention.

Next, the block diagrams of FIGS. 4 and 5 will now be described.

As shown in FIG. 4, control means 20 is a microcomputer which receives a control signal from the operation selecting means 10 and controls the robot cleaner 1.

Driving means for driving the robot cleaner 1 in the forward, backward, left and right directions, comprises a left driving unit 31 for driving the robot cleaner 1 in the right direction under the control of the control means 20, and a right driving unit 32 for driving the robot cleaner 1 in the left direction.

Travel distance detecting means 35 for detecting a traveled distance by the driving means, comprises a left encoder 351 for detecting the traveled distance in the right direction, by counting the rotations of left power wheel 316, that is, a counting pulse signals corresponding to the number of rotations of the left travel motor 314, and a right encorder 352 for detecting the traveled distance in the left direction, by counting the rotations of the right power wheel 326, that is, counting pulse signals corresponding the number of rotations of the right travel motor 324.

Tension control means 40, which controls the tension of the power cable 46 during movement of the robot cleaner 1, comprises a motor 44 for rotating the spool assemble 45 in the forward and reverse directions. A motor control unit 41 is provided for operating the motor 44 in the forward and reverse direction in order to wind the unwind the cable under the control of the control means 20. A rotation number sensing sensor 42 is provided for sensing the number of rotations of the motor 44 and outputting the sensed signal to the control means 20. Direction sensing means 43 is provided for sensing the rotating direction and the number of rotation of the spool assembly 45, and outputting the sensed signal to the control means 20.

Obstacle sensing means 50, which senses a presence of an obstacle and a distance to the obstacle on the cleaning range, comprises the ultrasonic sensor 51, which emits an ultrasonic wave in a moving direction while turning about 180 degrees. The sensor 51 receives the reflected wave in order to determine the presence of the obstacle. An amplifier 52 for amplifying the wave reflected from the obstacle, a filter 53 for filtering out a noise component from the amplified signal. A stepping motor driving unit 54 is provided for driving a stepping motor 53 under the control of the control means 20 in order to rotate the ultrasonic sensor 51 180 degrees.

Travel direction detecting means 60, which detects the traveled direction of the robot cleaner 1, comprises a rotation angle sensor 61 for sensing a rotation angle based upon a voltage level during movement of the robot cleaner 1 in order to determine a change of the moving direction. A compensation motor driving unit 62 is provided for driving a compensation motor 64 which rotates only the rotation angle sensing sensor 61. A rotation amount detecting unit 63 is provided for detecting a rotation amount of the rotation angle sensing sensor 61 and outputting it to the control means 20.

Memory means 70 is provided for increasing a memory capacity sufficiently to control the driving means, the tension control means 40 and the obstacle sensing means 50.

DRAM is used for the memory means 70.

Suction motor control means 80 activates the suction motor 81 under the control of the control means 20 in order to sucked up the dust or dirt from the floor. Charging means 90 charges the battery 91 during travel of the robot cleaner 1 level of change of the battery 91 is decreased to below a predetermined level.

Meanwhile, it is all right to use a battery of small capacity because the battery 91 is used for only moving the robot to the next area to be cleaned.

AC/DC converting means 100 converts AC from the power supply unit to DC, and outputs DC to the control means 20 as well as the other components.

Data transmitting/receiving unit 105 transmits data from the control means 20 to the power supply unit or vice versa.

In the drawing, a left driving unit 31 comprises a left motor control unit 311 for operating the left travel motor 314 to move the robot cleaner 1 in the right direction, and a left clutch driving unit 312 for driving the left clutch 312 to transmit or interrupt the driving force of the left power wheel 316.

A right driving unit 32 comprises a right motor control unit 321 for operating the right travel motor 324 to move the robot cleaner 1 in the left direction, and a right clutch driving unit 322 for driving the right clutch 325 to transmit the driving force of the right power wheel 326.

Figure 6:
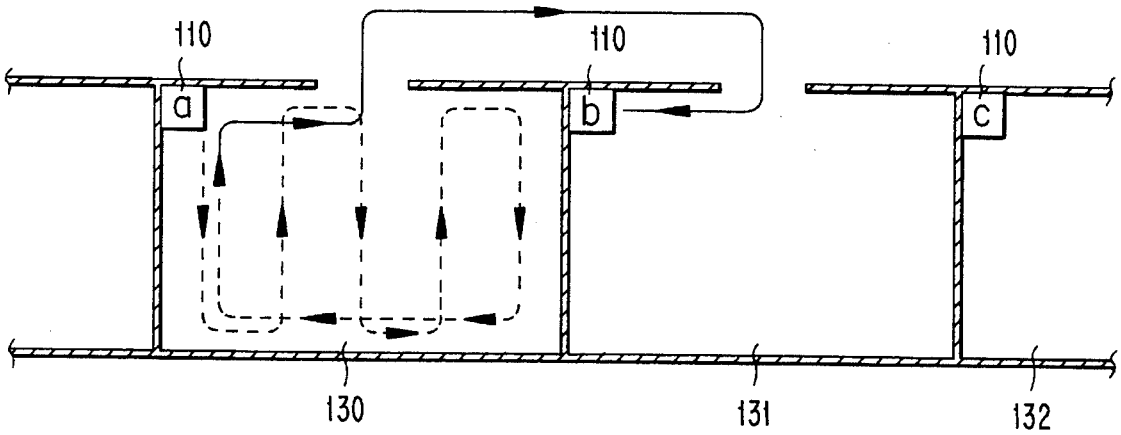
FIG. 6 shows a plan view of rooms to be cleaned, and a cleaning operation path for the robot cleaner according to the present invention.

The power supply unit 110 is provided at a predetermined place on the wall of each room being cleaned in order to supply AC from the AC input terminal 120 to the robot cleaner 1 under the control of the control means 20, as shown in FIG. 6.

The power supply unit 110 comprises; AC-to-DC converter 111 for converting AC from the AC input terminal 120 to DC, a power supply control unit 112 for controlling a solenoid 116 in order to supply AC to the robot cleaner 1 under the control of the control means 20, a solenoid driving unit 113 for driving the solenoid 116 under the control of the power supply control unit 112, a connection 114 for connecting the robot cleaner 1 with the power supply unit 110 when the solenoid 116 is operated by the solenoid driving unit 113, a display unit 115 for displaying a connected state between the robot cleaner 1 and the power supply unit 110 under the control of the control unit 112.

Next, an operation of the robot cleaner so constructed will be described.

The cord 46 of the robot cleaner 1 is connected to the power supply unit 110 disposed at the position "a" as shown in FIG. 6, and operates in response to the pushing of the operation/stop key 11.

At this time, operation of the robot cleaner 1 is initiated directly, or indirectly by a remote controller.

One direct method involves pushing the key 12 twice to establish a manual mode of operation.

The other direct method involves pushing the automatic selecting key 12 of the operation selecting means 10 once whereupon the robot cleaner 1 moves itself in the automatic mode. The automatic mode will now be described.

As described above, when the robot cleaner 1 is connected to the power supply unit 110, the control means 20 outputs a control signal to the power supply unit 110 through the data transmitting/receiving unit 105 in order to supply AC current from AC input terminal 120 to the robot cleaner 1.

Accordingly, the power supply control unit 112 outputs power to the solenoid driving unit 113 to thereby operate the robot cleaner 1 through the solenoid 116.

Accordingly, the control means 20 controls the left and right clutche driving units 312 and 322 to causes the clutches 315, 325 to transmit power the left and right power wheels 316 and 326 from the left and right travel motors 314 and 324.

The left and right motor control units 311 and 321 receive a control signal for the left and right travel motors 314 and 324 from the control means 20 in order to start the operation of the robot cleaner 1.

At this time, the left encoder 351 outputs to the control means 20 a pulse signal corresponding to the number of rotations of the left power wheel 316 and the right encoder 352 outputs a pulse signal corresponding to the number of rotations of the right power wheel 326 .

Accordingly, the control means 20 calculates the travel distance of the robot cleaner 1 on the basis of the pulse signal.

Meanwhile, the turning angle sensing sensor 61 senses an angular velocity of the left and right power wheels 316 and 326 and outputs it to the control means 20.

Accordingly, the control means 20 integrates the angular velocity in order to detect that whether the travel direction of the robot cleaner is changes.

That is, the control means 20 controls the left and right motor control units 311 and 321 so that the robot cleaner 1 moves in the predetermined direction without deviating from the normal travel path, represented by a dotted line as shown in FIG. 6.

The ultrasonic sensor 51 attached to the front of the robot cleaner 1 emits an ultrasonic wave in the moving direction, receives the reflected wave from an obstacle while it is turning 180 degrees in the left and right direction.

The amplifier 54 amplifies the reflected wave from the obstacle, the filter 53 filters out the noise component of the harmonic wave included in the amplified signal, and subsequently the filtered signal is inputted to the control means 20 in order to determine a presence of the obstacle and calculate a distance to the obstacle.

Subsequently, the control means 20 determines whether the obstacles is closer in the left or right direction in order to control the left and right travel motors 314 and 324 to divert the robot cleaner 1 smoothly.

Meanwhile, the suction motor driving means 80 receives a control signal for the suction motor 81 from the control means 20.

The suction motor 81 generates suction which draws dust and foreign material into the brush and through the inlet 2, and subsequently sucked dust and foreign material is collected in the bag 3 in the collecting chamber 4 through the conduit 6.

When the cleaning operation of the robot-cleaner 1 is completed, the control means 20 causes the robot cleaner to return to the original position or outputs a command signal for interrupting the power to the power supply unit 110 through the data transmitting/receiving unit 105. Thus the power supply control unit 112 controls the solenoid driving unit 113 so that the robot cleaner is electrically disconnected from the power supply unit 110.

Accordingly, the robot cleaner 1 can not receive the power from the AC input terminal 120, but rather receives DC from the battery 91 in order to move to the next region 131 to be cleaned, once the cord 46 is unplugged from the power supply 110 of room 130 and wound upon the spool 45.

Then the left and right motor driving units 311 and 321 receive a control signal from the control means 20 so that they operate the left and right travel motors 314 and 324, and thereby move the robot cleaner 1 to the next region 131 under battery power.

At this time, the left encoder 351 generates pulse signal corresponding to the number of rotations of the left power wheel 316, and the right encoder 352 generates the pulse signal corresponding to the number of rotations of the right power wheel 326 and those signals are delivered to the control means 20.

The control means 20 calculates the travel distance of the robot cleaner 1 on the basis of the pulse signals.

Meanwhile, the turning angle sensing sensor 61 senses an angular velocity of the left and right power wheels 316 and 326, and outputs a signal representative thereof to the control means 20.

Accordingly, the control means 20 integrates the angular velocity in order to determine whether the robot cleaner 1 changes the travel direction.

The control means 20 controls the left and right motor control units 311 and 321, to cause the robot cleaner 1 to be moved in the solid line direction, as shown in FIG. 6.

The ultrasonic sensor 51 emits the ultrasonic wave in the moving direction, and receives the reflected wave from obstacle.

The reflected wave from an obstacle is amplified to the predetermined level by the amplifier 54, the noise component of the harmonic wave included in the amplified signal is filtered out and the filtered signal is inputted to the control means 20.

Accordingly, the control means 20 determines the presence of the obstacle, and calculates the distance to the obstacle on the basis of the filtered signal.

The control means 20 determines whether the obstacle is closer to the left or right side of the robot cleaner 1 and controls the pulse width of the left and right travel motors 314 and 324, to thereby move the robot cleaner 1 smoothly past the obstacle.

The control means 20 outputs a command signal for supplying power to the power supply unit 110 through the data transmitting/receiving unit 105 when the robot cleaner 1 arrives at the power supply unit 110 at the position "b", so that the cord 46 can be plugged into the power supply 110 of room 131.

Accordingly, the AC input terminal 120 supplies AC to the robot cleaner 1 in order to clean the cleaning region 131.

The power supply unit 110 at the position "b" controls the power supply control unit 112 so that it controls the solenoid driving unit 113 to thereby operate the solenoid 116.

The solenoid 116 is operated by the solenoid driving unit 113 and then AC current from AC input terminal 120 is supplied to the robot cleaner 1 through the power supply unit 110 at the position "b".

Accordingly, the robot cleaner 1 successively moves to the cleaning regions, 130→131→132→. . . →X, thereby performing the cleaning operation.

At this time, the control means 20 determines whether the level of charge of the battery 91 is decreased below the predetermined level.

As a result, the control means 20 controls the charging means 90 when the level of charge the battery 26 is decreased to below the predetermined level.

Accordingly, the charging means 90 charges the battery 91 while the robot cleaner 1 performs the cleaning operation under AC power.

The user pushes the automatic selecting key 12 once more again in order to turn off the display unit 12*a* and set the robot cleaner 1 for operation in a manual mode.

At this time, the control means 20 controls the left and right clutch driving units 312 and 322 in order to prevent the power wheels 316, 326 from being driven by the left and right travel motors 314 and 324.

Accordingly, since the left and right power wheels 316 and 326 can not receive power from the left and right travel motors 314 and 324, the cleaning operation is performed under the user's own power.

Meanwhile, the user removes a cover (not shown) on the front of the robot cleaner 1 so that the suction conduit 7 may be attached to the front of the robot cleaner.

Under the this condition, the cleaning operation is performed by an operation switch on the suction conduit 7.

Having described specific preferred embodiments of the invention with reference to the accompanying drawings, it is to be understood that the invention is not limit to those precise embodiments, and that various changes and modifications may be effected therein by one skilled in the art without departing from the scope or spirit of the invention as defined in the appended claims.

What is claimed is:

1. A cleaning robot, comprising:

a control mechanism;

a power supply cord adapted for supplying electrical power to the control mechanism from an external power supply disposed in a region to be cleaned, the power supply cord being stored on the robot and adapted to be payed-out and drawn in during movement of the robot;

a battery connected to the control mechanism for supplying electrical power thereto independently of the external power supply;

a cleaning device connected to the control mechanism to be powered by the external power supply during a cleaning operation;

a motor-driven propulsion mechanism connected to the control mechanism for being powered solely by the external power supply during the cleaning operation, and powered solely by the battery during travel of the robot to the next region to be cleaned, the propulsion mechanism including a steerable ground support structure for being steered in response to signals received from the control mechanism, to establish a direction of travel of the robot;

a battery charging mechanism powered by the external power supply for recharging the battery during a cleaning operation;

a travel distance detecting mechanism for detecting a distance traveled by the robot;

a travel direction detecting mechanism for detecting changes in a travel direction of the robot;

an obstacle sensing mechanism for sensing a presence of an obstacle and a distance from the robot to the obstacle;

the travel distance detecting mechanism, the travel direction detecting mechanism, and the obstacle sensing mechanism being connected to the control mechanism to supply respective signals thereto for steering the steerable ground support structure and thereby establish a direction of travel of the robot;

the motor-driven propulsion mechanism, the travel distance detecting mechanism, the travel direction detecting mechanism, and the obstacle sensing mechanism all being operable by power supplied from an external power supply and by power supply from the battery.

2. The robot according to claim 1, wherein the cleaning device includes a suction generator, a suction inlet for receiving dust sucked-in from the floor, and a dust collector for collecting the sucked-in dust.

3. The robot according to claim 1, wherein the ground support structure comprises first and second rotatable ground support members, the motor-driven propulsion mechanism comprising first and second motors for driving the first and second ground support members, respectively, independently of one another for steering the robot.

4. The robot according to claim 3, wherein the motor-driven propulsion mechanism further comprises first and second clutches for transmitting drive forces from the first and second motors to the first and second ground support members, the clutches being independently actuable.

5. The cleaning robot according to claim 1, further including a tension control mechanism connected to the control mechanism for controlling tension of the power supply cord during movement of the robot.

6. The cleaning robot according to claim 5, further including a rotatable spool on which the power supply cord is wound, the tension control mechanism comprising a motor for rotating the spool selectively in forward and reverse directions, a motor control unit for operating the motor in the forward and reverse directions in order to wind or unwind the cord under the control of the control mechanism, a rotation number sensing means for sensing the number of rotations of the motor and outputting the sensed signal to the control mechanism, and a direction sensing means for sensing the rotating direction and the number of rotations of the spool assembly, and outputting the sensed signal to the control mechanism.

7. The cleaning robot according to claim 1, wherein the travel direction detecting mechanism comprises a rotation angle sensor for sensing a rotation angle in which the robot is turned, a compensation motor driving unit for driving a compensation motor which rotates only the rotation angle sensing sensor, and a rotation amount detecting unit for detecting a rotation amount of the rotation angle sensing sensor and outputting it to the control mechanism.

8. In combination, a cleaning robot and an external power supply, said robot comprising:

a control mechanism;

a power supply cord connectible to the external power supply for supplying electrical power to the control mechanism from the external power supply, the power supply cord being stored on the robot and adapted to be payed-out and drawn in during movement of the robot;

a cleaning device connected to the control mechanism to be powered by the external power supply during a cleaning operation;

a motor-driven propulsion mechanism connected to the control mechanism for being powered solely by the external power supply during the cleaning operation, and powered solely by the battery during travel of the robot to the next region to be cleaned, the propulsion mechanism including a steerable ground support structure for being steered in response to signals received from the control mechanism, to determine a direction of travel of the robot;

a battery charging mechanism powered by the external power supply for recharging the battery during a cleaning operation;

a travel distance detecting mechanism for detecting a distance traveled by the robot;

travel direction detecting mechanism for detecting changes in a travel direction of the robot; and obstacle sensing mechanism for sensing a presence of an obstacle and a distance from the robot to the obstacle;

the travel distance detecting mechanism, the travel direction detecting mechanism, and the obstacle sensing mechanism being connected to the control mechanism to supply respective signals thereto for steering the steerable ground support structure and thereby establish a direction of travel of the robot;

the motor-driven propulsion mechanism, the travel distance detecting mechanism, the travel direction detecting mechanism, and the obstacle sensing mechanism all being operable by power supplied from an external power supply and by power supply from the battery;

said external power supply comprising:

an AC/DC converter for converting AC current of the external power supply to DC current, a solenoid for electrically connecting the eternal power supply to the robot, a power supply controller for actuating the solenoid, and a display unit for indicating when the robot is connected to the external power supply.

9. The combination according to claim 8, wherein the external power supply comprises an electric solenoid actuable to effect electric connection between the power supply unit and the motor driven propulsion mechanism, a solenoid driving unit for actuating the solenoid, a display unit for providing an indication that the solenoid has been actuated, a power supply control unit connected to the solenoid driving unit and the display unit, and an AC-to-DC converter connected to the power supply control unit.

* * * * *